United States Patent [19]

Echtler

[11] Patent Number: 4,493,284

[45] Date of Patent: Jan. 15, 1985

[54] PONTOON FOR FLOATING BRIDGES AND FERRIES

[75] Inventor: Theodor Echtler, Kaiserslautern, Fed. Rep. of Germany

[73] Assignee: IBEK Ingenieurbuero Echtler Kaiserslautern GmbH, Kaiserslautern, Fed. Rep. of Germany

[21] Appl. No.: 468,648

[22] Filed: Feb. 22, 1983

[30] Foreign Application Priority Data

Feb. 20, 1982 [DE] Fed. Rep. of Germany ..... 3206222

[51] Int. Cl.[3] ..... B63C 1/02

[52] U.S. Cl. ..... 114/267; 114/49; 114/266; 405/219; 14/27

[58] Field of Search ..... 114/263, 266, 267, 49; 14/27, 28; 405/218, 219

[56] References Cited

U.S. PATENT DOCUMENTS

| | | | |
|---|---|---|---|
| 3,492,825 | 2/1970 | Pearson | 114/263 |
| 3,499,179 | 3/1970 | Weld | 114/267 |
| 3,651,528 | 3/1972 | Behrmann | 14/27 |
| 3,763,808 | 10/1973 | Smith, Sr. | 114/266 |

FOREIGN PATENT DOCUMENTS

| | | | |
|---|---|---|---|
| 1902791 | 10/1970 | Fed. Rep. of Germany | 114/266 |
| 7705635 | 11/1977 | Netherlands | 114/263 |

*Primary Examiner*—Trygve M. Blix
*Assistant Examiner*—Patrick W. Young
*Attorney, Agent, or Firm*—Shlesinger, Arkwright, Garvey & Fado

[57] ABSTRACT

A pontoon assembly for floating bridges includes four pivotally interconnected articulable floats providing a pontoon assembly having a folded and an unfolded position. Each of the floats is generally rectangularly shaped. In the unfolded position the pontoon assembly has an inner two floats and an outer two floats and the outer two floats are lengthwise connected to an outer edge of the inner two floats. The inner two floats each have an upper surface which provides a vehicular roadway. A rectangular recess is disposed in each of the outer two floats and the recess has a size sufficient to permit a ramp part to be removably positioned in there. The ramp parts have a height corresponding to the depth of the recess in order to provide a flush upper surface with the upper surface of the associated outer float. Each of the ramp parts includes lugs to permit connection with an inner float to thereby provide a closed rampway.

5 Claims, 5 Drawing Figures

FIG. 4
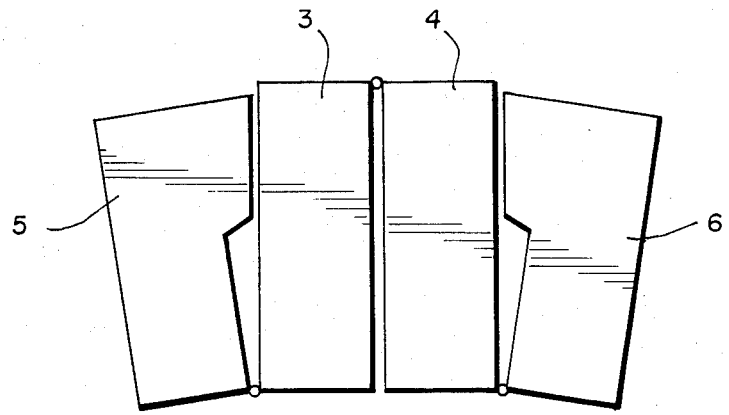
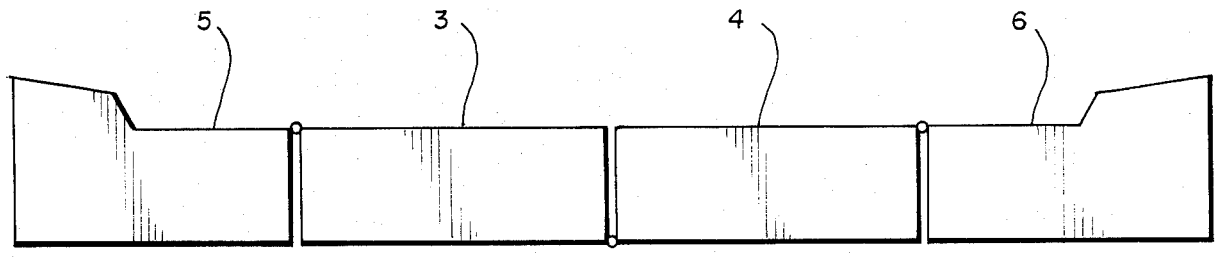
FIG. 5

PONTOON FOR FLOATING BRIDGES AND FERRIES

The invention concerns a pontoon for floating bridges and ferries, consisting of four unfoldable and collapsible floats, whereby a treadway leads into at least one of the outer floats, which treadway has couplings on at least one transverse side for articulation to the outer edges of the inner floats.

Unfoldable and collapsible pontoons for floating bridges and ferries have been known for some time. Such pontoons are described, for example, in German OS 30 03 397. Embodiments are known in these types of pontoons in which a treadway leads into each outer float. These treadways can be removed from the outer floats by means of a crane which can be built up, and they can be articulated to the transverse edges of the inner floats by simple bolt couplings in order to establish a connection to a bank section.

However, these treadways can only be used in exceptional instances, since they are relatively short. They are therefore only suitable for bank slopes where the pontoon can be brought close enough to the bank. In most instances, however, this is not possible because of the draft of the pontoon, so that the treadways can not be used. So called ramp sections are therefore used in these predominating instances which are unfoldable and collapsible like pontoons, but have a shallow draft. In contrast to the treadways they form a closed roadway, which is desireable for reasons of safety.

However, the ramp sections described above are relatively expensive on account of their complicated folding mechanisms. Moreover, they require their own vehicle for transport.

The invention therefore has the task of finding a solution for the ramps of floating bridges or ferries which allows such bridges and ferries to be assembled using only one type of pontoon and can nevertheless be used for most types of banks.

This task is solved by the invention as follows: The treadway is constructed as a ramp part which extends over approximately the entire length of the outer floats, and the width of the ramp part is such and the couplings to them and to the inner floats are arranged in such a manner that at least two and preferably four ramp parts are articulated adjacent to each other to the inner floats to form a closed ramp.

According to the invention, ramps can be assembled from such pontoons by removing preferably four ramp parts from each one, which ramps are like those which could only be made previously by means of special ramp sections. The ramps form a closed roadway and can bridge approximately the same distance as a ramp section and are accordingly very versatile. In addition, the individual ramp parts can be adapted more easily to irregular bank slopes than a rigid ramp section can.

An essential advantage is the price, because two or even more such ramp parts are considerably cheaper than a separate ramp section with its expensive folding mechanism. Moreover, only one pontoon type need now be built, which is more advantageous for mass production and maintenance. Finally, at least two transport vehicles per floating bridge can be eliminated, as the ramp parts fit snugly into the pontoons and are transported with them.

This is all the more advantageous if the ramp parts in a floating bridge constructed with such pontoons are also used as connections between two adjacent pontoons. This can be done if the floating bridge is intended to carry only a rather light load. This eliminates pontoons, which do not have to be transported. In addition, this makes possible a better adaptation to the particular distance to be bridged, because the ramp parts are somewhat shorter than the pontoons. Thus, the pontoon of the invention is distinguished on the whole by its versatility of use and its low cost.

The invention provides that the ramp part or parts have couplings on both transverse sides for the connection of two pontoons by ramp parts as was described previously. It is advantageous if the ramp parts are also constructed as floats.

A variation of the invention suggests that the ramp part or parts can be coupled to adjacent ramp parts. In this manner the ramp consisting of the ramp parts can be raised up as a unit, so that the pontoon can also be used as a ferry. The raising can be performed by a collapsible crane which can be set in recesses in the corners of the outer floats.

The invention is explained in more detail in the embodiments shown in the drawings.

FIG. 4 is a side elevational view of the pontoons of the invention in the folded position; and, FIG. 5 is a side elevational view similar to that of FIG. 4 with the pontoons in the unfolded position.

Figure 1:
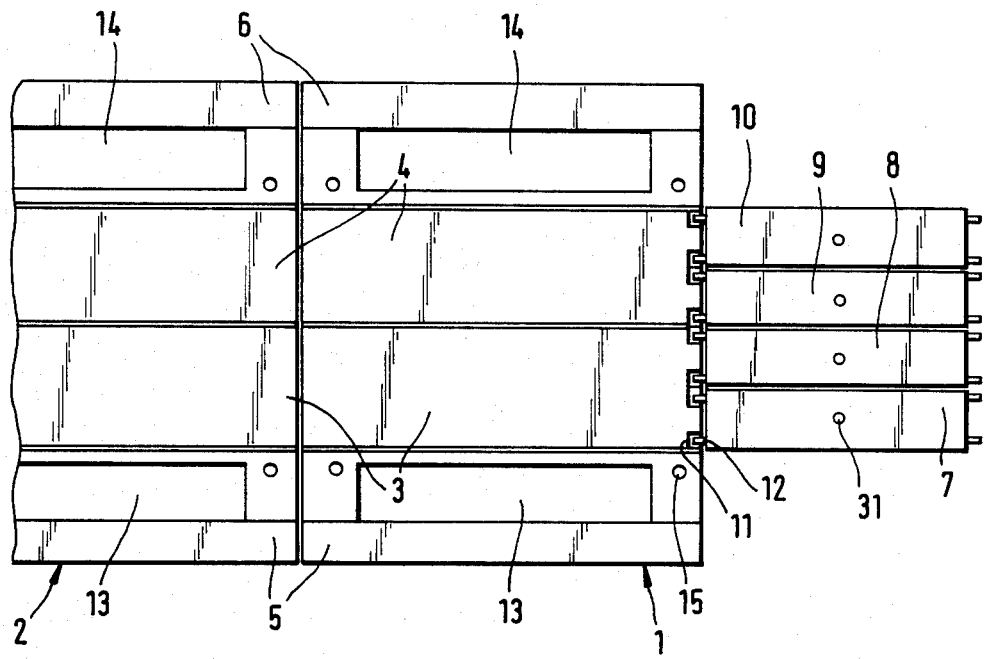
FIG. 1 shows a top view of two pontoons with ramp.

Each of the two pontoons 1, 2 shown in FIG. 1, of which the left one is only partially shown, consists of two inner floats 3, 4 and of two outer floats 5, 6. These floats are connected in an articulated manner to each other in such a way that they can be folded together in a W. The inner floats 3, 4 form the roadway for the vehicles.

A total of four ramp parts 7, 8, 9, 10 are articulated by their short sides to the right (in this view) transverse side of right pontoon 1. The articulated connection is established in a customary manner by lugs 12 which fit into recesses 11 on pontoon 1 and are locked by suitable bolts.

Ramp parts 7, 8, 9, 10 are approximately as along as pontoons 1 and 2 and are constructed so that they can resist the vehicle load, yet are so flat that vehicles can drive directly from the ramp onto the bank. They have lowerable raising eyelets (31) into which the hook of a crane can fit.

When they are not being used, and especially for transport, ramp parts 7, 8, 9, 10 are set into fitting recesses 13, 14 formed in the outer floats 5, 6 of the pontoons 1, 2. Recesses 13, 14 are shaped so that after ramp parts 7, 8, 9, 10 have been inserted, they are flush with the surfaces of outer floats 5, 6, so that they can be walked on.

Receiver bores 15 are provided next to the front sides of recesses 13, 14 into which bores a crane can be inserted for raising ramp parts 7, 8, 9, 10 out of recesses 13, 14.

Figure 2:
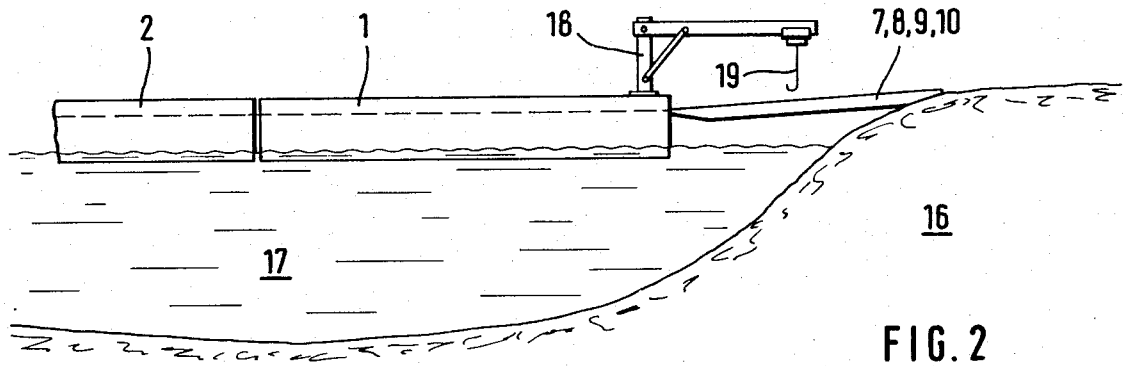
FIG. 2 shows a section through a body of water with the pontoons and the ramp of FIG. 1.

FIG. 2 shows a section through the bank slope 16 of a body of water 17. Pontoons 1, 2 are floating on the body of water 17 with ramp parts 7 in place, whereby their free ends rest on bank slope 16. Collapsible crane 18 is inserted into one of receiver bores 15. Ramp parts 7, 8, 9, 10 can be raised by crane hook 19 and after the lock on pontoon 1 has been released, they can be placed back into one of recesses 13, 14. Ramp parts 7, 8, 9, 10 can also be raised together by crane 18 when ramp parts 7, 8, 9, 10 are coupled together. Pontoons 1, 2 can then be used as a ferry.

Figure 3:
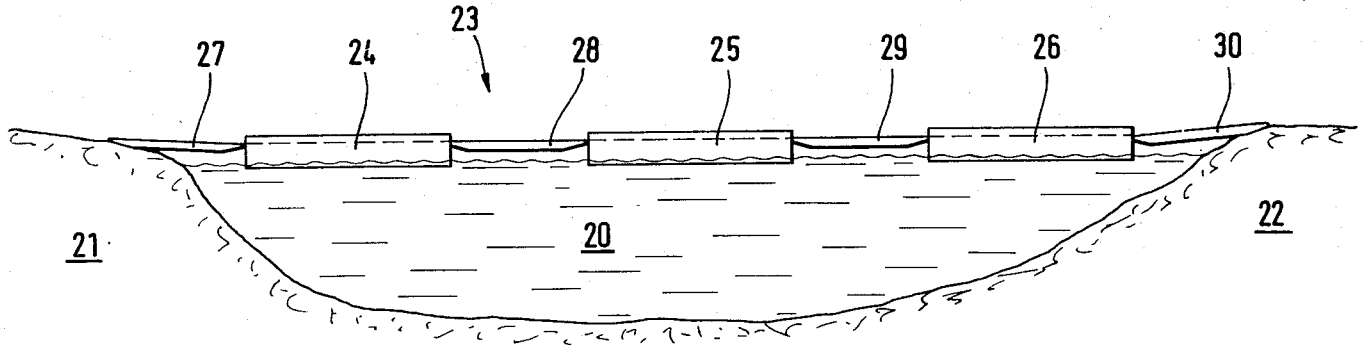
FIG. 3 shows a section through a body of water with a floating bridge.

FIG. 3 also shows a section through a body of water 20. Here, the two bank slopes 21, 22 are connected by floating bridge 23 which is alternatingly composed of pontoons 24, 25, 26 and several ramp parts 27, 28, 29, 30. It is apparent that ramp parts 27, 28, 29, 30 can be used not only for establishing a connection to the banks 21, 22, but also for coupling two pontoons 24, 25, 26. In this manner a floating bridge can be composed of only a few pontoons if it does not carry a heavy load.

Such a construction of floating bridge 23 can also achieve a better adaptation to the width of the body of water 20 to be bridged, since ramp parts 27, 28, 29, 30 are somewhat shorter than pontoons 24, 25, 26. It is not necessary that the pontoons and the ramp parts alternate with each other, but several pontoons can be located between the ramp parts.

The connection between two pontoons or between a pontoon and the bank is normally established by four adjacent ramp parts in order to create a closed roadway. However, it is also possible to use fewer, but at least two ramp parts, depending on the intended use of the bridge.

I claim:

1. A pontoon assembly for floating bridges and the like, comprising:

(a) four pivotally interconnected articulable floats providing a pontoon assembly having a folded position and an unfolded position;

(b) said floats being generally rectangularly shaped and of substantially equal dimensions and having a length greatly exceeding the width;

(c) said floats when in said unfolded position providing an adjacent inner two floats and an outer two floats and each of said outer two floats is lengthwise connected to an outer edge portion of one of said two inner floats;

(d) each of said inner two floats has an upper surface when in said unfolded position for providing a vehicular roadway;

(e) a rectangular recess disposed in each of said outer two floats and having a length substantially equal to said float length and a width substantially equal to one-half said float width;

(f) at least two rectangular ramp parts having a length and width substantially corresponding to said recess length and width and each of said ramp parts removably positionable in one of said recesses;

(g) each of said ramp parts has a height corresponding to the depth of said associated recess whereby an upper surface of said ramp part is flush with an upper surface of the associated outer float for providing a personnel walkway when in said unfolded position and for permitting said floats to assume said folded position;

(h) each of said ramp parts has lugs extending outwardly lengthwise from the ends thereof; and, (i) each of said inner floats has a plurality of recesses disposed along the widthwise ends thereof and said inner floats recesses adapted for removably receiving therein said lugs of said ramp parts when said ramp parts are removed from said recesses for thereby providing a closed rampway.

2. The assembly as defined in claim 1, wherein:

(a) each of said ramp parts includes coupling means for connecting two of said pontoon assemblies with at least one of said ramp parts.

3. The assembly as defined in claim 1, wherein:

(a) said ramp parts are constructed as floats.

4. The assembly as defined in claim 1, wherein:

(a) at least a first recess disposed in one of said outer floats at generally one corner thereof; and, (b) a collapsible crane including means adapted to be received in said corner recess whereby said crane is supported by said outer float.

5. The assembly as defined in claim 1, wherein:

(a) at least two pontoon assemblies are interconnected by one of said ramp parts for thereby providing a floating bridge.

* * * * *